US006202435B1

(12) United States Patent
Fujitaka et al.

(10) Patent No.: US 6,202,435 B1
(45) Date of Patent: Mar. 20, 2001

(54) EXPLOSION PREVENTING APPARATUS FOR REFRIGERATING MACHINES USING INFLAMMABLE REFRIGERANT

(75) Inventors: Akira Fujitaka; Yoshinori Kobayashi, both of Shiga (JP)

(73) Assignee: Matsushita Electric Inductrial Co., Ltd., Kadoma (JP)

( * ) Notice: Subject to any disclaimer, the term of this patent is extended or adjusted under 35 U.S.C. 154(b) by 0 days.

(21) Appl. No.: 09/331,152

(22) PCT Filed: Oct. 16, 1998

(86) PCT No.: PCT/JP98/04682

§ 371 Date: Jun. 17, 1999

§ 102(e) Date: Jun. 17, 1999

(87) PCT Pub. No.: WO99/20946

PCT Pub. Date: Apr. 29, 1999

(30) Foreign Application Priority Data

Oct. 21, 1997 (JP) ..... 9-306582

(51) Int. Cl.[7] ..... F25B 1/00
(52) U.S. Cl. ..... 62/331; 62/114
(58) Field of Search ..... 361/816, 819, 361/220; 62/114, 331

(56) References Cited

U.S. PATENT DOCUMENTS 3,179,852 * 4/1965 Seagreaves ..... 361/819
3,339,117 * 8/1967 Fisher ..... 361/819
4,468,702 * 8/1984 Jandrell ..... 361/220
5,177,660 * 1/1993 Kilner ..... 361/220
5,801,330 * 9/1998 Gademann et al. ..... 361/819

FOREIGN PATENT DOCUMENTS 51-28674 * 3/1976 (JP) .
7-55298 * 3/1985 (JP) .
5-199701 * 8/1993 (JP) .

* cited by examiner

*Primary Examiner*—William E. Tapolcai
(74) *Attorney, Agent, or Firm*—Armstrong, Westerman, Hattori, McLeland & Naughton

(57) ABSTRACT

An explosion preventing device for a refrigerating machine using a flammable refrigerant according to a first embodiment of the present invention comprises a mesh member which covers a part or component or a control section. The mesh member has a mesh size which is equal to or smaller than a quenching distance for the flammable refrigerant used. By covering the part or the like which may generate electric sparks, with the mesh member having the mesh size equal to or smaller than a quenching distance, as described above, even if the sparks are generated to produce flames, when the refrigerant is leaked, the flames cannot be propagated to the outside of the mesh member. Therefore, even if the sparks are generated when the refrigerant is leaked, a serious explosion or fire cannot be caused.

4 Claims, 2 Drawing Sheets

EXPLOSION PREVENTING APPARATUS FOR REFRIGERATING MACHINES USING INFLAMMABLE REFRIGERANT

FIELD OF THE INVENTION

The present invention relates to an explosion preventing device for a refrigerating machine using a flammable refrigerant.

BACKGROUND ART

It is said that an HCFC-based refrigerant represented by R22 presently utilized in an air conditioner destroys an ozone layer due to the stability of physical properties thereof.

In recent years, an HFC-based refrigerant has been started to be utilized as a substitute for the HCFC-based refrigerant. However, the HFC-based refrigerant has a nature that it promotes the global warming phenomenon.

Therefore, recently, the employment of an HC-based refrigerant which does not cause the destruction of the ozone layer and the global warming phenomenon is being examined.

However, this HC-based refrigerant is flammable and hence, it is necessary to previously prevent the explosion and ignition of the HC-based refrigerant and to ensure the safety.

Therefore, there are proposed methods for previously preventing the explosion and ignition of the HC-based refrigerant, wherein the igniting source is eliminated or isolated, or placed remotely (for example, see Japanese Patent Application Laid-open Nos.7-55267 and 8-61702).

In the methods in which the igniting source is eliminated, it has been proposed that a non-contact relay generating no spark is used, ora contact portion is sealed. With this method, however, the part or component used is limited, but also it is difficult to completely eliminate sparks in all the parts or a control section.

In the methods in which such part or component are isolated from a place where there is a possibility that the refrigerant may be leaked. In the methods in which the igniting source is placed remotely, it has been proposed that a part accommodating box is placed in an outdoor unit of the air conditioner, or outside a housing of a refrigerator. However, such methods brings about a disadvantage in a respect of space, but also possibly causes an electric leakage or a short-circuit due to the leading-about of wires.

Accordingly, the present invention has been accomplished by paying an attention to the fact that even if a flammable gas is ignited, the flames are not propagated, if flat plates are spaced at a certain distance or less apart from each other, and it is an object of the present invention to ensure that even if the ignition occurs due to the generation of sparks or the like, the flames are prevented from being propagated, thereby preventing the occurrence of the serious explosion or fire.

DISCLOSURE OF THE INVENTION

To achieve the above object, according to claim 1 of the present invention, there is provided an explosion preventing device for a refrigerating machine using a flammable refrigerant, comprising a mesh member which covers a relay for controlling the operation and the stoppage of a compressor or an air blower, or a part or component or a control section, which may generate electric sparks, the mesh member having a mesh size equal to or smaller than a quenching distance for the flammable refrigerant used. By covering the part or the like which may generate the sparks, with the mesh member having the mesh size equal to or smaller than the quenching distance, as described above, even if the sparks are generated to produce flames when the refrigerant is leaked, the flames cannot be propagated out of the mesh member. Therefore, even if the sparks are generated when the refrigerant is leaked, they cannot cause a serious explosion and fire.

According to claim 2 of the present invention, there is provided an explosion preventing device for a refrigerating machine using a flammable refrigerant, comprising an accommodating member which covers a relay for controlling the operation and the stoppage of a compressor or an air blower, or a part or component or a control section, which may generate electric sparks, a portion of the accommodating member being formed from a mesh member which has a mesh size equal to or smaller than a quenching distance for the flammable refrigerant used. By using the mesh member for a portion of the accommodating member, as described above, the part or the like covered with the accommodating member can be cooled. Even if electric sparks are generated within the accommodating member to produce an explosion, when the refrigerant is leaked, the sudden expansion of a gas within the accommodating member can be released to the outside by the mesh member. Therefore, the accommodating member can be prevented from being broken, and flames cannot be propagated to the outside of the accommodating member. Thus, even if the sparks are generated when the refrigerant is leaked, a serious explosion or fire cannot be caused.

According to claim 3 of the present invention, in addition to the feature of claim 1 or 2, the flammable refrigerant used is propane or isobutane, and the mesh size of the mesh member is equal to or smaller than 2 mm. By using the mesh member having the mesh size equal to or smaller than 2 mm, flames can be prevented from being propagated.

According to claim 4 of the present invention, there is provided an explosion preventing device for a refrigerating machine using a flammable refrigerant, comprising a punched member which covers a relay for controlling the operation and the stoppage of a compressor or an air blower, or a part or component or a control section, which may generate electric sparks, the punched member having punched holes whose size is equal to or smaller than a quenching diameter for the flammable refrigerant used. By covering the part or the like which may generate electric sparks, with the punched member having the punched holes whose size is equal to or smaller than the quenching diameter, as described above, even if the sparks are generated to produce flames, when the refrigerant is leaked, the flames can be prevented from being propagated. Thus, even if the sparks are generated when the refrigerant is leaked, a serious explosion or fire cannot be caused.

According to claim 5 of the present invention, there is provided an explosion preventing device for a refrigerating machine using a flammable refrigerant, comprising an accommodating member which covers a relay for controlling the operation and the stoppage of a compressor or an air blower, or a part or component or a control section, which may generate electric sparks, a portion of the accommodating member being formed from a punched member having punched holes whose size is equal to or smaller than a quenching diameter for the flammable refrigerant used. By using the punched member for a portion of the accommodating member, as described above, the part or the like can be covered with the accommodating member. Even if electric sparks are generated within the accommodating member to produce an explosion, when the refrigerant is leaked, the sudden expansion of a gas within the accommodating member can be released to the outside by the punched member. Therefore, the accommodating member can be prevented from being broken, and the flames cannot be propagated to the outside of the accommodating member. Thus, even if the sparks are generated when the refrigerant is leaked, a serious explosion or fire cannot be caused.

According to claim 6 of the present invention, in addition to the feature of claim 4 or 5, the flammable refrigerant used is propane, and the diameter of the punched holes in the punched member is equal to or smaller than 3 mm. By using the punched member having the punched holes whose size is equal to or smaller than 3 mm, as described above, the flames of the propane cannot be propagated.

According to claim 7 of the present invention, there is provided an explosion preventing device, comprising a mesh member or a punched member which is used in or around a relay for controlling the operation and stoppage of a compressor or an air blower, a part or component or a control section which may generate electric sparks, thereby preventing the propagation of flames. By utilizing the mesh member or the punched member, as described above, even if electric sparks are generated to produce flames, when the refrigerant is leaked, the flames can prevented from being propagated to cause a serious explosion or fire, without changing the part itself to a part which generates no electric spark and without placement of the part or the like at a remote location.

According to claim 8 of the present invention, in addition to the feature of claim 7, said part or said control section is a part or a control section which generates a heat and which is required to be cooled. Such part or the like generating the heat cannot be sealed and for this reason, it is preferred to utilize the mesh member or the punched member which enables cooling air to be guided to the part or the like and also enables the heat to be released to the outside.

According to claim 9 of the present invention, there is provided a refrigerating machine using a flammable refrigerant, comprising an explosion preventing device according to claim 7 or 8, which is mounted in a space within a housing of an indoor unit or outdoor unit of an air conditioner, or a dehumidifier, a vending machine or a refrigerator. Such space within the housing has a high risk of causing the explosion, because the leaked refrigerant is liable to be accumulated in the space. However, by utilizing the explosion preventing device in the embodiment according to claim 7 or 8, even if electric sparks are generated to produce flames, when the refrigerant is leaked, the flames cannot be propagated to cause a serious explosion of fire.

BEST MODE FOR CARRYING OUT THE INVENTION

An explosion preventing device for a refrigerating machine using a flammable refrigerant according to an embodiment of the present invention will be described as being utilized in an air conditioner.

Figure 1:
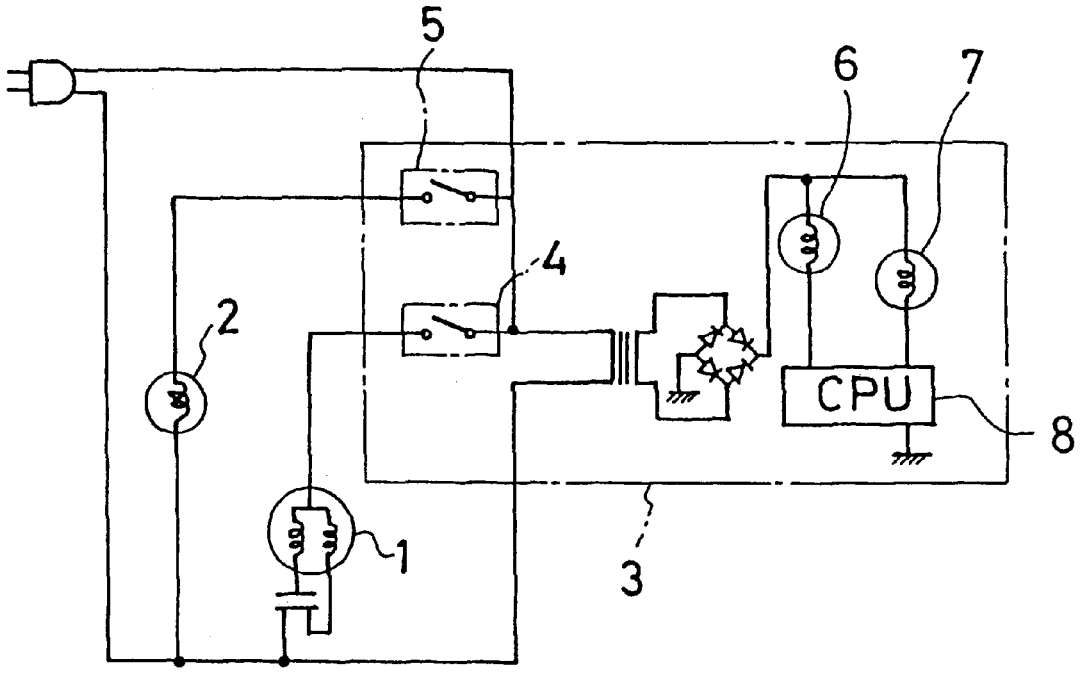
FIG. 1 is a diagram of an electric circuit for explaining an embodiment of the present invention.
Figure 2:
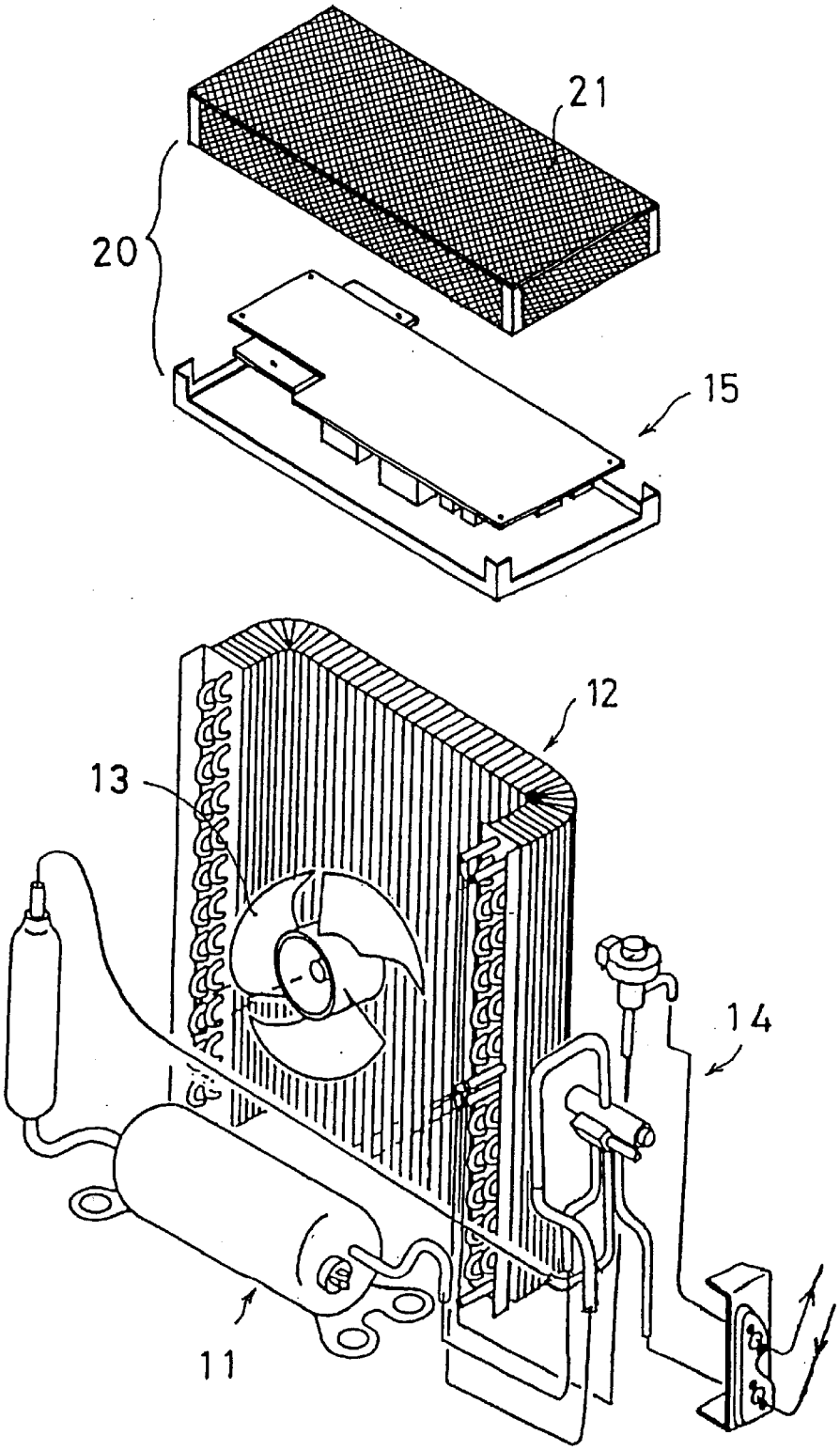
FIG. 2 is a perspective view of an outdoor unit of an air conditioner according to the embodiment of the present invention.

FIG. 1 is a diagram of a portion of an electric circuit used in an air conditioner according to the embodiment; and FIG. 2 is a perspective view showing the outline of an outdoor unit of the air conditioner using an explosion preventing device.

First, the electric circuit will be described in brief with reference to FIG. 1.

A compressor motor 1 for driving a compressor and a fan motor 2 for driving an outdoor fan are controlled in running and stoppage by a control unit 3. The control unit 3 comprises compressor relay contact 4 for controlling the energization of the compressor motor 1, a fan relay contact 5 for controlling the energization of the fan motor 2, a compressor relay coil 6, a fan relay coil 7, and a CPU 8 for controlling the energization of the compressor relay coil 6 and the fan relay coil 7.

The outdoor unit of the air conditioner will be described below with reference to FIG. 2.

A compressor 11, an outdoor heat exchanger 12, an outdoor fan 13 and the like are accommodated in a space within a housing of the outdoor unit. The compressor 11, the outdoor heat exchanger 12 and the like are interconnected by a pipe 14 to constitute a refrigerating cycle. A refrigerant used in the refrigerating cycle is a flammable refrigerant such as propane, isobutane or the like. The housing has a space provided in its upper portion, and a control section 15 constituting the electric circuit described with reference to FIG.1 can be accommodated in the space 15.

The control section 15 is covered with an accommodating member 20. The side and upper walls of the accommodating member 20 are formed from a mesh member 21, excluding a bottom surface on which the control section 15 is placed.

The mesh size of the mesh member 21 will be described below.

The term "quenching distance" is referred to the maximum distance between two flat plates, which does not enable flames to be propagated between two flat plates. It is known that the quenching distance is closely related to a minimum ignition energy. The relationship between the quenching distance measured by an electric spark process and the minimum ignition energy is approximately represented by the following equation:

$$D=0.35E^{1/2}$$

wherein D is a quenching distance (cm), and E is a minimum ignition energy (mJ).

In addition, the following relationship is established between the quenching distance D and a quenching diameter d.

$$D=0.7d$$

For example, when propane is ignited by electric sparks, the electrical energy is about 0.7 to 0.3 mJ.

Therefore, when propane is used, the quenching distance is 2 mm, and the quenching diameter is 3 mm.

Thus, it is preferred that the mesh size of the mesh member 21 is equal to or smaller than 2 mm. When a punched member is used in place of the mesh member 21, it is preferred that the diameter of punched holes is equal to or smaller than 3 mm.

In the present embodiment, the control section 15 including a part which may generate electric sparks as described above is covered with the accommodating member 20, and the upper and side walls of the accommodating member are formed from the mesh member 21. Thus, even if the flammable refrigerant is leaked to enter the accommodating member 20 to become inflamed, the resulting flames cannot be propagated to the outside of the accommodating member 20 to reach the explosion or the fire.

By the fact that the control section 15 is mounted in the space in the upper portion of the housing 10 of the outdoor unit as in the present invention, the possibility of entering of the refrigerant leaked in the housing into the accommodating member can be reduced.

In the embodiment, the upper and side walls of the accommodating member is formed from the mesh member. Alternatively, only the upper wall or the side wall of the accommodating member may be formed from the mesh member, or only the bottom wall may be formed from the mesh member. Not only a portion of the accommodating member is formed from the mesh member as described above, but also the part or the like may be covered with the mesh member.

The quenching distance and the quenching diameter for the propane have been described in the embodiment, but the quenching distance and the quenching diameter for isobutane are the same as for the propane.

INDUSTRIAL APPLICABILITY

As discussed above, according to the present invention, even if the ignition or inflaming occurs due to the generation of the electric sparks, a serious explosion or fire can be prevented by preventing the propagation of the resulting flames.

What is claimed is:

1. An explosion preventing device for a refrigerating machine using a flammable refrigerant, comprising a mesh member which covers one of (1) a relay for controlling the operation and the stoppage of a compressor or an air blower, and (2) a part, a component or a control section, which may generate electric sparks, said mesh member having a mesh size equal to or smaller than a quenching distance for the flammable refrigerant used, wherein the flammable refrigerant used is one of propane and isobutane, and the mesh size of said mesh member is equal to or smaller than 2 mm.

2. An explosion preventing device for a refrigerating machine using a flammable refrigerant, comprising an accommodating member which covers one of (1) a relay for controlling the operation and the stoppage of a compressor or an air blower, and (2) a part, a component or a control section, which may generate electric sparks, a portion of said accommodating member being formed from a mesh member which has a mesh size equal to or smaller than a quenching distance for the flammable refrigerant used, wherein the flammable refrigerant used is one of propane and isobutane, and the mesh size of said mesh member is equal to or smaller than 2 mm.

3. An explosion preventing device for a refrigerating machine using a flammable refrigerant, comprising a punched member which covers one of (1) a relay for controlling operation and the stoppage of a compressor or an air blower, and (2) a part, a compound or a control section, which may generate electric sparks, said punched member having punched holes whose size is equal to or smaller than a quenching diameter for the flammable refrigerant used, wherein said flammable refrigerant used is propane, and the diameter of the punched holes in the punched member is equal to or smaller than 3 mm.

4. An explosion preventing device for a refrigerating machine using a flammable refrigerant, comprising an accommodating member which covers one of (1) a relay for controlling the operation and the stoppage of a compressor or an air blower, and (2) a part, a component or a control section, which may generate electric sparks, a portion of said accommodating member being formed from a punched member having punched holes whose size is equal to or smaller than a quenching diameter for the flammable refrigerant used, wherein said flammable refrigerant used is propane, and the diameter of the punched holes in the punched member is equal to or smaller than 3 mm.

* * * * *